United States Patent [19]

Conner et al.

[11] 3,996,543

[45] Dec. 7, 1976

[54] CURRENT TRANSFORMER

[75] Inventors: Edmond E. Conner, Brookfield, Ohio; James E. Smith, Farrell, Pa.

[73] Assignee: Westinghouse Electric Corporation, Pittsburgh, Pa.

[22] Filed: Feb. 4, 1976

[21] Appl. No.: 655,307

[52] U.S. Cl. ..... 336/58; 29/606; 336/174; 336/213; 336/217

[51] Int. Cl.[2] ..... H01F 27/06; H01F 27/30; H01F 40/06

[58] Field of Search ..... 29/605, 606; 336/84, 336/60, 175, 176, 173, 92, 94, 211, 212, 213, 216, 217, 58

[56] References Cited

UNITED STATES PATENTS 3,344,383 9/1967 Aberizk ..... 336/217 X

*Primary Examiner*—Thomas J. Kozma
*Attorney, Agent, or Firm*—D. R. Lackey

[57] ABSTRACT

A high voltage current transformer, and method of constructing same, including a primary winding having concentric leads, and a secondary winding on a magnetic core which is inductively linked with the primary winding. The magnetic core is a wound, two part core, with the two core parts being joined by stepped-lap joints. The secondary winding is a distributed winding having turns which are uniformly distributed about the complete magnetic circuit of the magnetic core. The conductor of the secondary winding is severed and the associated ends electrically re-connected, each time the conductor passes a stepped-lap joint.

9 Claims, 7 Drawing Figures

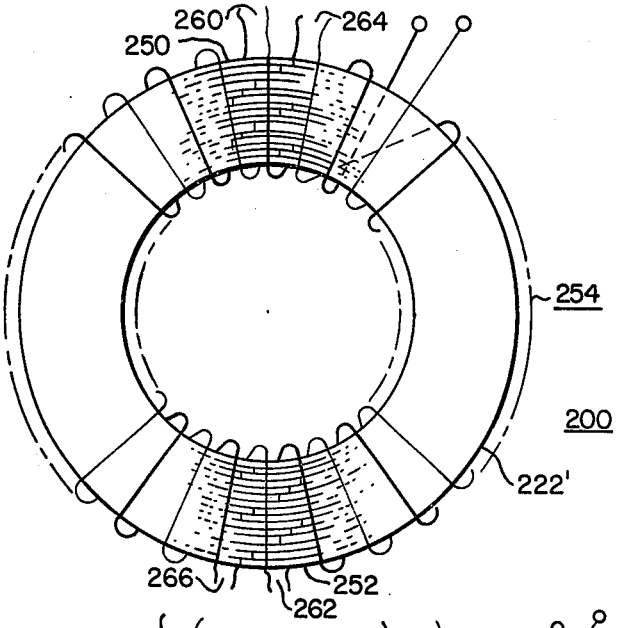
FIG.5
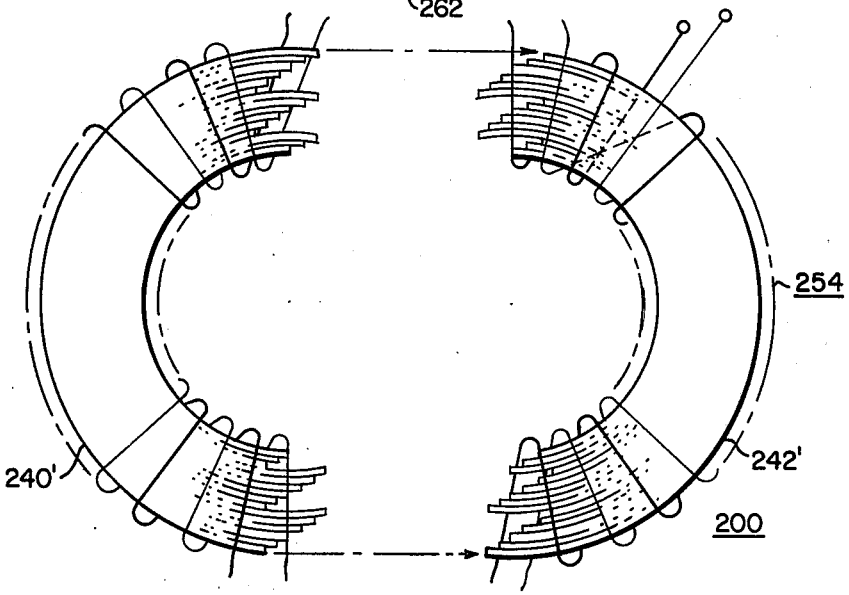
FIG.6
FIG.7
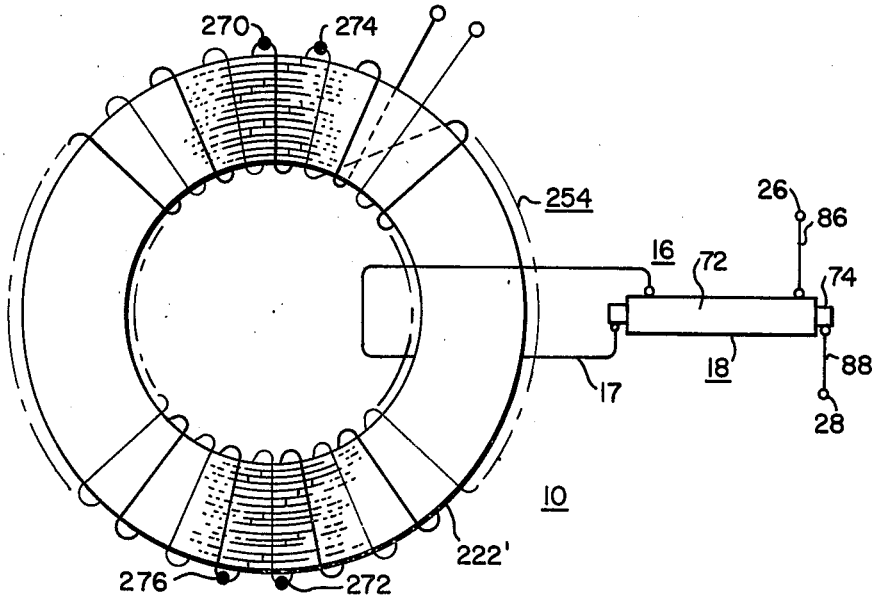

CURRENT TRANSFORMER

BACKGROUND OF THE INVENTION

1. Field of the Invention

The invention relates in general to electrical inductive apparatus, such as instrument transformers, and more specifically to new and improved high voltage current transformers.

2. Description of the Prior Art

Protective relaying and metering functions require very precise measurement of the current flowing in electrical power circuits. Current transformers for measuring current flow must be constructed to have a very low exciting current, so the ampere turns in the secondary winding closely match the ampere turns of the primary winding. Current transformers should also be constructed to have as small a leakage flux as possible. In conventional power transformers, the leakage flux is much smaller than the working flux and is thus a negligible factor when calculating exciting current, especially since the exact value of the exciting current is not significant In the current transformer, however, the leakage flux is of the same order of magnitude as the working flux, and the exact value of the exciting current is of major importance.

When the current transformer is to measure the current flow in high voltage, and extra high voltage (EHV) circuits, the current transformer is subject to the hereinbefore mentioned requirements, and its construction is complicated by the fact that the primary winding must be insulated to withstand the very high voltages involved. While the voltage across the terminals of the primary winding of the current transformer is small, the voltage from the primary winding to ground is the same as the voltage of the circuit whose current is being measured.

A prior art arrangement for obtaining the required current transformer performance is to use a bushing-type current transformer as the secondary winding. The bushing-type current transformer has a low loss ring magnetic core wound from a strip of magnetic material, which construction allows distributed secondary windings or coils to be used. The leakage flux is also kept out of the core in a bushing transformer, and thus does not increase the exciting current. The bushing-type current transformer, however, being a ring-shaped structure, requires a primary winding construction which will accept the "window" type construction. A common prior art primary winding which will accept a bushing current transformer for the secondary winding is U-shaped, and is commonly referred to as a "hairpin" primary. A disadvantage of the hairpin primary is the fact that the high voltage bushing must have a diameter which will accept the spaced legs of the hairpin configuration.

U.S. Pat. No. 3,299,383, which is assigned to the same assignee as the present application, discloses a current transformer structure which is especially useful for EHV, wherein the primary winding is a loop, the ends of which are connected to concentric high voltage leads. The advantages of this arrangement, which arrangement is commonly referred to as an "eye bolt" primary, include the fact that efficient cooling of the primary winding and lead arrangement may be achieved, regardless of the thickness of the solid insulation, and the concentric leads enable a much smaller diameter high voltage bushing to be used, which substantially reduces the cost of the bushing. The magnetic core, however, is constructed of flat metallic laminations which are stacked by hand to provide a four-sided magnetic core structure which encircles the insulated loop of the primary winding. The joints at the corners of the magnetic core introduce core losses, necessitating more core material than would be required in a comparable bushing-type current transformer secondary, and the secondary winding is machine wound and placed on a leg of the magnetic core. Leakage flux, however, will link the legs of the core which do not contain the secondardy winding, and will thus undesirably increase the exciting current which adversely affects the ratio or phase angle of the current transformer. This is especially true due to the clearances required at EHV voltages, which cause a relatively high leakage flux. Thus, it is necessary to add one or more equalizer coils to the stacked core legs which do not contain the secondary winding. The equalizer coils have the same number of turns as the secondary winding, and they are connected in parallel therewith. In EHV current transformers, three equalizer coils are normally used, each of which has the same number of turns as the secondary winding.

With the secondary winding and equalizer coils all connected in parallel, the output voltages of the secondary winding and equalizer coils must be the same. Therefore, the induced voltages in the secondary winding and equalizer coils must be nearly equal, and the flux linking the secondary winding and equalizer coils must be nearly equal. Thus, if leakage flux attempts to flow through the magnetic core, currents will be induced into the equalizer coils which will oppose and divert the leakage flux into the air, thus keeping it out of the core. Therefore, the saving savings the cost of the bushing are just about offset by the larger magnetic core, and the cost of stacking the core, and the cost of the equalizer coils.

SUMMARY OF THE INVENTION

Briefly, the present invention is a new and improved current transformer suitable for high and extra high power voltages, and a method of constructing same, which combines advantages of the prior art hairpin and eye bolt primary winding constructions without their disadvantages. The new and improved current transformer utilizes an eye bolt type of primary winding, which enables a small diameter high voltage bushing to be used due to the concentric lead arrangement. The secondary winding and core arrangement is equivalent in performance to a bushing-type current transformer secondary, enabling less core material to be used, and eliminating the need for equalizer coils.

The magnetic core is a ring-type core, wound from a strip of magnetic material similar to the core of a bushing-type transformer. The core build is then cut twice to separate the core into two equal halves or core parts. The half turn laminations in each core part are shifted relative to one another such that their ends define a predetermined stepped relationship, with the stepped ends at the ends of one core part being complementary to the stepped ends of the other core part.

The magnetic core is re-assembled into a ring configuration, forming two stepped-lap joints. The stepped-lap joints provide a low loss joint comparable to a solid ring core, and it has been used to advantage in portable split or separable core current transformers which removably clamp the core about a conductor, as disclosed in U.S. Pat. No. 3,339,163, which is assigned to the same assignee as the present application.

A distributed type secondary winding is wound about the assembled ring core with the desired number of turns being obtained by spacing the turns of the first pass around the circumference of the core such that the like numbered turns of subsequent passes around the core will be adjacent like numbered turns of the first pass. The passes extend from core part to core part, passing over the two stepped-lap joints. The turns of the distributed winding are not placed directly over the stepped-lap joint, which typically extends only for about 1.5 inch (3.81 cm). The conductor portion of each pass which interconnects turns on the two core parts is severed adjacent each stepped-lap joint, the two core parts are separated and placed about the insulated primary winding loop, the core is re-assembled by closing the stepped-lap joints, and the cut ends of the conductor of each pass are electrically re-connected. The distributed winding prevents leakage flux from entering the core, eliminating the need for equalizer coils, and the low losses of the core enable the core weight to be substantially reduced, compared with the stacked core.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIGS. 2–7 diagrammatically illustrate steps in the construction of the current transformer shown in FIG. 1.

DESCRIPTION OF THE PREFERRED EMBODIMENTS

Figure 1:
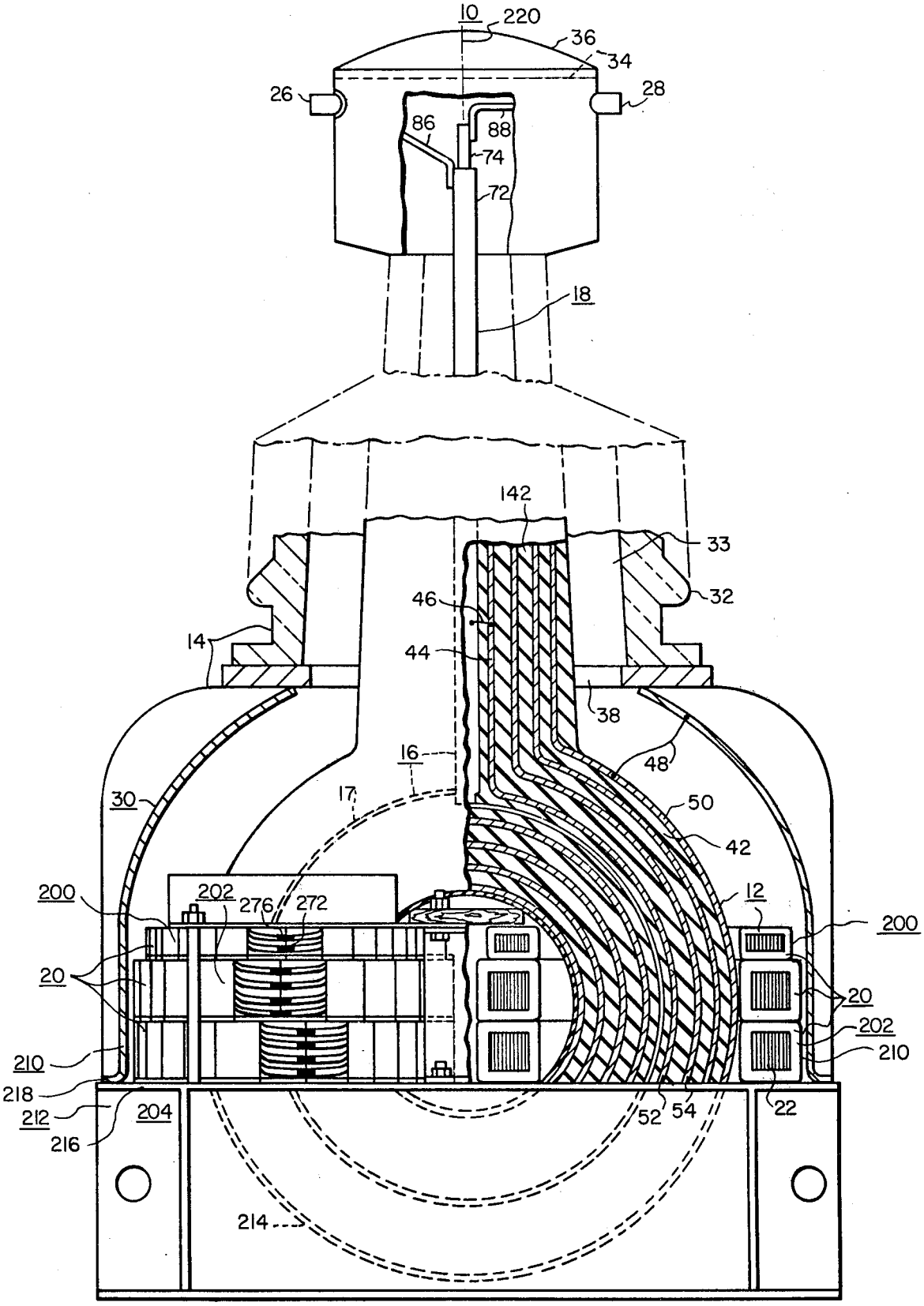
FIG. 1 is an elevational view, partially in section, of a current transformer constructed according to the teachings of the invention.

Referring now to the drawings, and FIG. 1 in particular, there is illustrated an elevational view, partially in section, of a high voltage current transformer 10 constructed according to the teachings of the invention. Certain portions of current transformer 10 may be constructed according to the hereinbefore mentioned U.S. Pat. No. 3,299,383, and thus these portions will not be described in detail. Accordingly, the subject matter of U.S. Pat. No. 3,299,383 is hereby incorporated into this application by reference.

Current transformer 10 includes a winding-core assembly 12 disposed within a suitable housing 14. The winding-core assembly 12 comprises a primary or high voltage winding assembly 16, a secondary or low voltage winding assembly 20, and magnetic core means 22. The low voltage winding assembly 20 may include one or more separate windings, each disposed in inductive relation with a magnetic core member, with the number of secondary winding and core members depending upon the requirements of the particular application the current transformer 10 is to be utilized with. For example, FIG. 1 illustrates a low voltage winding assembly having six secondary winding and core members 200, 202, 204, 206, 208, and 210, each constructed according to the teachings of the invention, as will be hereinafter described.

The primary winding assembly 16 includes high voltage winding section 17 and lead assembly 18, with the lead assembly 18 extending upwardly from the high voltage winding section 17 for connection to terminals 26 and 28. Terminals 26 and 28 are adapted for connection to an alternating current power system whose current is to be measured or sensed.

Housing 14 includes a tank 30 having upper and lower portions 211 and 212, respectively, which cooperatively contain the high and low voltage winding assemblies 16 and 20, respectively, and a hollow cylindrical porcelain bushing or outdoor weather housing 32 having a central opening 33 which is tapered in cross section along its vertical axis 220, for enclosing the high voltage lead assembly 18. The lower portion 212 of the tank 30 includes a curved "form-fit" bottom portion 214 which forms a well, and a horizontal flange 216 surrounding the well. The flange 216 and bottom 214 support the winding-core assembly 12 during manufacture of the current transformer 10, as well as in the final assembled product. The upper portion 211 of the tank 30 includes a flange 218 which cooperates with the flange 216 to provide a fluid-tight seal when the tank portions are assembled and suitably interconnected. Tank 30 has an opening 38 disposed through its top, and the bushing 32 is disposed in sealed engagement with the upper portion 211, with the vertical axis 220 substantially perpendicular to the top portion and with the opening 33 in the bushing 32 being in registry or alignment with the opening 38 in the top portion 211 of the tank 30. The tank 30 and bushing 32 are filled with a suitable fluid dielectric for cooling and insulating the transformer 10, such as oil, which is introduced into the housing until it reaches the level indicated at line 34. An expansion cap 36 is disposed at the top of bushing 32, to allow for expansion and contraction of the fluid dielectric as the thermal condition of the current transformer 10 changes during operation.

In order to insulate the high voltage winding section 17 from the flow voltage winding assembly 20 and from the grounded portions of the transformer housing, such as the tank 30, solid insulation 42 is disposed to surround the high voltage section 17. The solid insulation 42 may be any suitable insulating material, such as crepe paper, in sheet or tape form, which is either taped, wrapped or folded around the high voltage winding section 17, and between the high voltage winding section 17 and low voltage winding assembly 20.

In order to electrically insulate the high voltage lead assembly 18 from the grounded portion of the transformer housing 14, such as the portion of the tank 30 which surrounds the opening 38, solid insulation 142 is disposed to substantially surround at least the major vertical portion of the lead assembly 18. The solid insulation 142 may be similar to the solid insulation 42 surrounding the high voltage winding section 17, and may be crepe paper in flexible sheet form which is taped, wrapped or folded about the lead assembly 18. The thickness of the solid insulation 142 is generally tapered from a maximum value at the lower portion of the lead assembly 18 to a minimum value near the upper portion of the lead assembly. The entire solid insulation structure may be oil impregnated using high vacuum techniques.

In order to reduce the concentration of dielectric stress in the solid insulation 42 surrounding the high voltage winding section 17, and in the solid insulation 142 surrounding the lead assembly 18, an inner shielding member 44 is disposed to substantially surround the high voltage winding section 17 and the major portion of lead assembly 18. The inner shield 44 may be formed of a flexible conducting material having a layer of insulation secured thereto, such as crepe paper backed metallic foil.

The upper end of the inner shielding member 44 is electrically connected to lead assembly 18 electrical conductor 46, in order for the shielding member 44 to provide a substantially equipotential surface around the high voltage winding section 17 and high voltage lead assembly 18, which is at substantially the same potential as the high voltage winding 17, to thereby substantially eliminate any potential stress to which any fluid dielectric inside said lead assembly is subjected.

In order to reduce the concentration of dielectric stress in the solid insulation 142 which surrounds lead assembly 18 adjacent to the grounded portions of the tank 30 through which said lead assembly 18 passes, and to substantially eliminate any potential stress to which the fluid dielectric is subjected inside the tank 30 and in the lower portion of the central opening of the bushing 32, an outer shielding member 50 is disposed to substantially surround the high voltage winding section 17 and its associated solid insulation 42, as well as the lower portion of lead assembly 18 and the solid insulation 142 which is disposed around said lead assembly.

The outer shielding member 50 forms a continuous electrically conductive surface or electrode having a cylindrical configuration around the high voltage winding section 17 and a generally hollow-cylindrical shape around the lower portion of lead assembly 18. The outer shielding member 50 is maintained at ground or zero potential by electrically connecting said shielding member by a flexible conducting lead 48 to the tank 30 or any other grounded portion of the transformer 10.

In order to reduce the maximum potential gradient in the solid insulation 42 adjacent the outer corners of high voltage winding section 17, and produce a favorable voltage distribution longitudinally along the bushing 32, as described in detail in U.S. Pat. No. 3,173,114, which is assigned to the same assignee as the present application, a plurality of intermediate shielding members such as indicated at 52 and 54 are disposed to substantially surround the high voltage winding section 17 and the lower portion of the lead assembly 18. Only two intermediate shielding members, 52 and 54, are shown for simplicity, but it is to be understood that for extra high voltage ratings, it may be desirable to have a larger plurality of intermediate shielding members.

The high voltage lead assembly 18 includes two concentrically disposed electrically conductive tubular members 72 and 74, which are connected to the ends of the high voltage winding section 17 and which extend vertically upward therefrom through opening 38 in the tank 30, through opening 33 in bushing member 32, and into the expansion cap 36. The diameter and wall thickness of the tubular members 72 and 74 are selected to allow tubular member 72 to be telescoped over tubular member 74, and axially aligned to provide a predetermined space between the outer diameter of tubular member 74 and the inner diameter of tubular member 72. Thus, the lead assembly 13 comprises inner and outer spaced tubular or hollow conductors 74 and 72, respectively, disposed on a common center line or vertical axis. The inner conductor 74 has a length which exceeds the length of the outer conductor, to allow it to extend past both ends of the outer conductor.

Thus, lead assembly 18 has two separate flow paths for insulating fluid, the first being the space formed by the inside diameter of the inner lead conductor 74, and the second being the space formed between the outside diameter of inner lead conductor 74 and the inside diameter of outer lead conductor 72.

Electrical conductor 86 connects the outer tubular lead conductor 72 with terminal 26 which is electrically insulated from the expansion cap 36, and electrical conductor 88 connects the upper extension of inner lead conductor 74 with terminal 28 which is electrically connected to the expansion cap 36.

The high voltage winding section 17 is formed of a single electrically conductive member, and is shaped into one or more turns having channels or grooves formed therein for purposes of providing a coolant flow path when solid insulation is disposed thereon.

A complete uninterrupted flow path for the dielectric fluid is established from the flow path between the tubular leads or lead conductors 72 and 74, through the grooves or channels in the winding section 17, and through the space in the inside diameter of lead conductor 74.

The high voltage winding and lead assembly 16 is completed by the disposition of the solid insulation 42 and 142 thereon, along with the shielding members hereinbefore described, and the assembly 16 is then placed in the tank bottom portion 212 with the longitudinal axis of the lead assembly being oriented along the center line 220.

Each of the secondary winding and core assemblies are formed in like manner according to the teachings of the invention, and since their structures are similar, and since they may be manufactured by using the same steps, only secondary winding and core assembly 200 will be described in detail. The structure of secondary winding and core assembly 200 will be understood from a description of a new and improved method of constructing the assembly, with FIGS. 2 through 7 illustrating various steps in the manufacture of the assembly 200, as well as of the manufacture of the current transformer 10.

Figure 2:
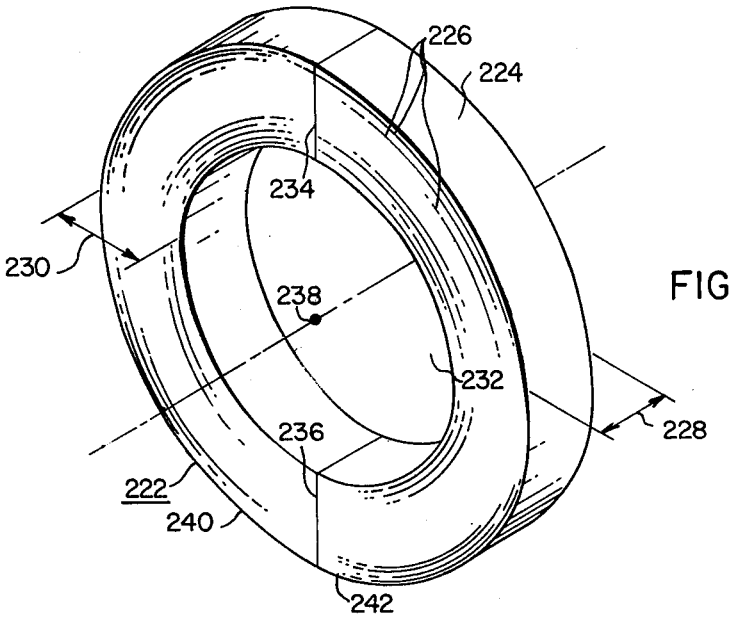

More specifically, FIG. 2 is a perspective view of a magnetic core 222 which illustrates initial steps in the construction of the magnetic core which will be used in the assembly 200. Magnetic core 222 is formed by winding a strip 224 of oriented, magnetic material, such as 11 mil electrical steel, about a mandrel to form a plurality of nested lamination turns 226. The strip 224 has a predetermined width dimension, indicated by arrow 228, which is selected to provide the desired thickness dimension of the core, and the strip is wound to provide a predetermined build dimension, indicated by arrow 230. The winding mandrel is selected to provide the desired opening or window 232, through which the primary and secondary windings will pass.

After the ring core 22 is wound to the desired dimensions, its cross section or build is taped at spaced locations about the periphery of the core and the core is cut completely through its build at 234 and 236. The cuts are 180 degrees apart in a common plane which intersects the geometrical center 238 of the core, dividing the core 222 into first and second equal core parts 240 and 242, respectively.

The laminations of each core part are then shifted relative to one another to form a predetermined stepped relationship between the ends of the laminations at each end of the core part, with the stepped relationships of one core part being complementary to those of the other. U.S. Pat. Nos. 2,973,494 and 2,972,804, which are assigned to the same assignee as the present application, illustrate arrangements which may be used to form the desired stepped relationship between the ends of the laminations. The stepped pattern may be of any suitable design. It may step in one direction for a plurality of laminations, i.e., at least 3, and preferably for about 6, and then repeat, or it may then step backwards, as desired. It is desirable in the application of the stepped-lap core joint to EHV current transformers to keep the circumferential length of the stepped-lap joint to about 1.5 inches. In order to reduce the length of the stepped-lap joint, the laminations of the core parts 240 and 242 are preferably grouped into a plurality of groups with the ends of the laminations of each group being stepped to provide the desired stepped relationship. After the ends of the laminations of each group are shifted, the groups are then reunited into their original core part.

Figure 3:
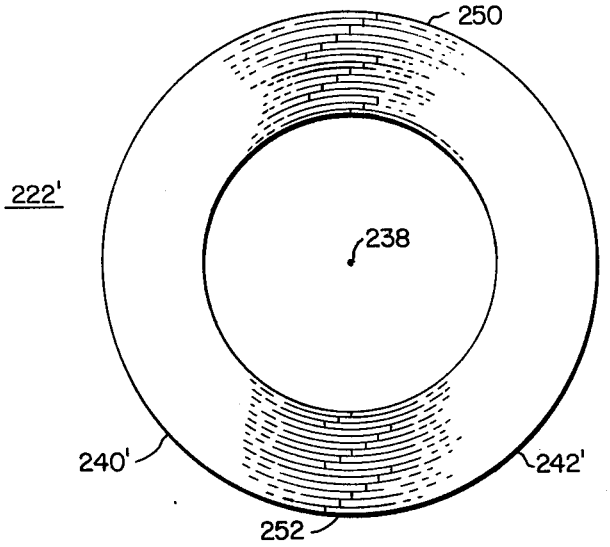

After the core parts 240 and 242 have their laminations shifted into the desired stepped pattern, providing core parts 240' and 242', respectively, they are assembled to provide a ring by fitting the complementary stepped ends together, which forms a ring core 222', shown in FIG. 3, having first and second stepped-lap joints 250 and 252, respectively. As illustrated in FIG. 3, ring core 222' has three groups of stepped-lap joints, with the laminations of the innermost group having one-half the number of laminations of the two outer groups. Thus, if the maximum circumferential dimension of the stepped-lap joint is about 1.5 inches, the laminations associated with the joint of the innermost group would extend over a length of about 0.75 inch. However, the arrangement shown in FIG. 2 is for illustration only, as other suitable stepped-lap arrangements may be used.

After the ring core 222' is formed with the stepped-lap joints, a distrubuted secondary winding 254 is wound about the cross section or build of the core. Instead of winding the desired number of turns of the secondary winding in sequence about the circumference of the ring, it is preferable, especially when the winding is tapped, to space the turns such that only a predetermined portion of the total number of turns are wound on the core for each 360° travel of the winding operation about the core. For example, the turns may be spaced and applied such that one-tenth of the turns are applied to the core in one complete pass, requiring 10 passes to complete the winding. Thus, the first turns of the passes are all adjacent one another, the second turns of the passes are all adjacent one another, etc. However, the conductor associated with each pass is connected in series with the conductors of all of the other paths, and the complete winding may thus be wound from a single conductor.

When winding each pass, no conductor turns are applied directly over the 1.5 inch circumferential length associated with each stepped-lap joint.

Figure 4:
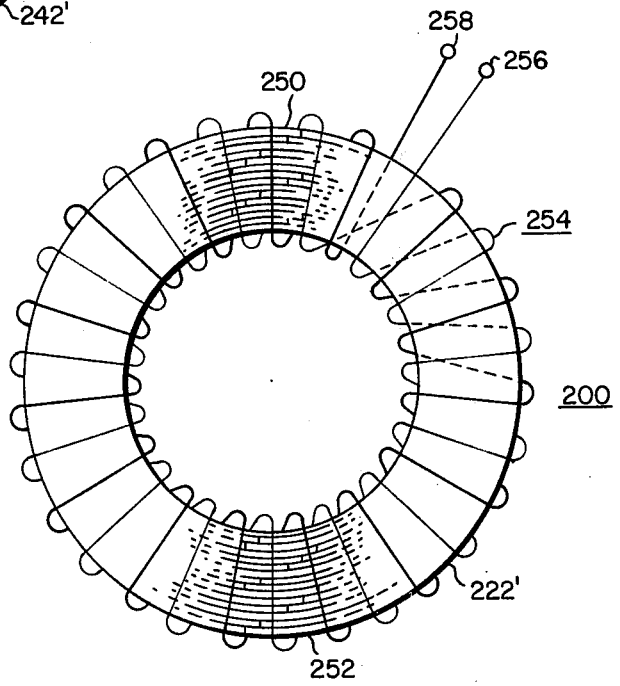

FIG. 4 illustrates the secondary winding 254 with two passes about the circumference of the core 222'. The turns of the second pass are indicated by thicker lines than the turns of the first pass. Start and finish ends of the winding 254 are indicated at 256 and 258, respectively. Taps (not shown) may be connected to selected turns of the winding 254, if the winding is to be capable of providing a plurality of different ratios.

FIG. 5 illustrates the next step of the method. The conductor portion of each winding pass is severed where it crosses a stepped-lap joint. Thus, the conductor of the first pass is severed at 260 and 262 adjacent the stepped-lap joints 250 and 252, respectively, and the conductor of the second pass is severed at 264 and 266 adjacent stepped-lap joints 250 and 252, respectively.

FIG. 6 illustrates the next step of the method, with the two core parts 240' and 242' being separated at their stepped-lap joints, along with the winding turns of the secondary winding wound thereon. These core parts are then re-assembled to link the primary winding 17, as shown diagrammatically in FIG. 7, and also in FIG. 1. As illustrated in FIG. 1, the flange 216 of the lower tank portion 212 provides a support for the secondary winding and core assemblies, facilitating the placement of the core parts about the insulated primary winding loop, and also the closing of the stepped-lap joints to restore the integrity of the ring core.

After the two core parts are assembled, the associated severed ends of the conductor of each pass are electrically reconnected and insulated, with the severed ends shown at 260 in FIG. 5 being reconnected at 270 in FIG. 7, ends 262 reconnected at 272, ends 264 reconnected at 274, and ends 266 reconnected at 276.

When the required number of secondary winding and core assemblies are all linked with the primary winding and clamped solidly to the lower tank portion 212, as shown in FIG. 1, and the ends and taps of the windings are connected to a suitable terminal box (not shown), the upper tank portion 211 is placed over the lower tank portion and the mating flanges are connected and sealed to provide a fluid-tight seal. Bushing 32 is then placed over the lead assembly on the upper tank and sealed thereto, and the expansion cap 36 is placed on the upper end of the bushing 32 and sealed thereto. Oil or other suitable insulating fluid is then added to the resulting housing, such as through an opening in the expansion cap.

A 1300 BIL EHV current transformer having a 2000:5 ampere ratio was constructed according to the teachings of the invention, and compared with a current transformer of like rating and ratio constructed according to the teachings of the incorporated U.S. Pat. No. 3,299,383. While the performance of the two current transformers both met the performance specification, the amount of iron and copper required to achieve these performances were significantly lower in the current transformer constructed according to the teachings of the invention. A 37% reduction in core weight was achieved, and an 81% reduction in copper weight was realized. Also, the form-fit construction resulted in a 28% reduction in the amount of oil required. The prior art current transformer with oil weighed approximately 7000 pounds, while the current tranformer constructed according to the teachings of the invention weighed about 5000 pounds, which is a 28% reduction in total weight.

In summary, there has been disclosed a new and improved high voltage current transformer which utilizes the eye bolt primary construction, desirable because of the small diameter insulating bushing required, and which utilizes new and improved secondary winding-core arrangements which enable the advantages of the hairpin type primary winding to be achieved in that wound cores with distributed windings are used, resulting in substantial savings in iron and copper, as well as substantial labor savings in the construction of the core.

We claim as our invention:

1. A method of constructing a current transformer having a primary and a secondary winding, comprising the steps of:

forming a first electrical conductor into a loop configuration having first and second ends, disposing a second electrical conductor within the opening of a tubular third electrical conductor, connecting the second and third electrical conductors to the first and second ends, respectively, of the first electrical conductor to form a primary winding and lead assembly, winding a magnetic strip material to provide a plurality of superposed turns in the form of a ring-shaped core loop having a predetermined build, cutting the ringshaped core loop across the build at first and second locations 180° apart to form first and second core parts each having a plurality of nested one-half turns of magnetic strip material, shifting the adjacent ends of the one-half turns in each of the first and second core parts to provide predetermined stepped relationships between the adjacent ends of the one-half turns, with the predetermined stepped relationship at each end of each core part being complementary with the stepped relation at an end of the other core part, assembling the first and second core parts with the complementary stepped ends cooperating to provide a ring core having first and second stepped-lap joints, winding a fourth electrical conductor about the build of the assembled ring core to provide the secondary winding, with the fourth electrical conductor passing over each of said first and second stepped-lap joints to provide conductor turns on each core part, cutting the fourth electrical conductor at each point where it interconnects turns on each core part to enable the ring core to be separated, separating the first and second core parts, assembling the first and second core parts about the first electrical conductor, with the complementary stepped ends again cooperating to provide the ring core with the first and second stepped-lap joints, and electrically connecting the associated cut ends of the fourth electrical conductor to re-establish the integrity of the secondary winding.

2. The method of claim 1 including the steps, prior to the step of assembling the first and second core parts about the first electrical conductor, of:

insulating the primary winding and lead assembly, forming a support and partial tank for the insulated primary winding and lead assembly, which includes the step of forming a curved bottom portion matched to the curved configuration of the insulated primary winding located opposite to the lead assembly, and placing the insulating primary winding and lead assembly into the support with the longitudinal axis of the lead assembly being substantially vertically aligned.

3. The method of claim 2 including the step of providing a horizontal flange about the top of the support, with the flange providing support for the assembled first and second core parts.

4. The method of claim 3 including the steps of:

providing an upper tank having a flange, mounting the upper tank on the support with its flange mating with the flange on the support, mounting an insulating bushing on the upper tank about the lead assembly to complete a fluid-tight housing for the current transformer, and filling the housing with a fluid dielectric.

5. A current transformer, comprising:

a primary winding including a metallic loop having first and second ends, a lead assembly including first and second concentrically disposed, electrically conductive members connected to the first and second ends, respectively, of said metallic loop, a wound magnetic ring core linking the metallic loop of said primary winding, and a secondary winding having first and second ends linking the ring core, said ring core having a plurality of radially superposed turns of magnetic material each cut to provide first and second stepped-lap joints which divide the ring core into first and second parts, said secondary winding including an electrical conductor wound to provide a plurality of conductor turns distributed about said ring core from part-to-part thereof, with said electrical conductor passing over each of said first and second stepped-lap joints, said electrical conductor being severed and the associated severed ends electrically connected, each time said electrical conductor passes one of said first and second stepped-lap joints.

6. The current transformer of claim 5 wherein each turn of magnetic material of the ring core is cut to provide two half turns, the ends of which are aligned to form a complete turn having first and second joints, with the first and second joints of each turn being shifted relative to the first and second joints, respectively, of adjacent turns to provide the first and second stepped-lap joints, respectively.

7. The current transformer of claim 5 wherein the electrical conductor of the secondary winding is wound about the ring core with at least two passes such that the turns of a pass are spaced apart and the turns of a subsequent pass are disposed between the spaced turns of the prior pass.

8. The current transformer of claim 5 including solid insulating means disposed about the primary winding and lead assembly, with the ring core being linked with the insulated metallic loop such that a selected curved portion of the insulated metallic loop is free of the ring core, and a housing including a tank having a curved portion for receiving the selected curved portion of the insulated metallic loop.

9. The current transformer of claim 8 wherein the housing includes a bushing assembly mounted on the tank which surrounds the lead assembly connected to the metallic loo, and fluid dielectric means disposed in the housing.

* * * * *